US006918843B1

(12) United States Patent
Franssen

(10) Patent No.: US 6,918,843 B1
(45) Date of Patent: Jul. 19, 2005

(54) BASEBALL TRAINING BAT

(76) Inventor: Micheal E. Franssen, 780 Maud Ave., San Leandro, CA (US) 94577

( * ) Notice: Subject to any disclaimer, the term of this patent is extended or adjusted under 35 U.S.C. 154(b) by 505 days.

(21) Appl. No.: 09/772,689

(22) Filed: Jan. 30, 2001

(51) Int. Cl.[7] ..... A63B 69/00
(52) U.S. Cl. ..... 473/457; 473/422
(58) Field of Search ..... 473/564–567, 473/457, 519, FOR 101, FOR 168, FOR 169; 463/47.1–47.7

(56) References Cited

U.S. PATENT DOCUMENTS

| | | | | |
|---|---|---|---|---|
| 514,420 | A | 2/1894 | Jacobus | |
| 670,141 | A | * 3/1901 | Shepard | 463/47.4 |
| 875,273 | A | 12/1907 | Kimble | |
| 1,499,128 | A | 6/1924 | Shroyer, Jr. | |
| 1,611,858 | A | * 12/1926 | Middlekauff | 473/566 |
| 2,021,741 | A | * 11/1935 | Mug | 273/317.6 |
| 2,379,006 | A | 6/1945 | Johnson | |
| 3,116,926 | A | 1/1964 | Owen et al. | |
| 3,179,412 | A | * 4/1965 | Niederberger | 473/588 |
| 3,246,894 | A | * 4/1966 | Salisbury | 473/256 |
| 3,479,030 | A | 11/1969 | Merola | |
| 3,921,976 | A | * 11/1975 | Lane | 473/458 |
| 3,963,239 | A | 6/1976 | Fujii | |
| 4,149,724 | A | * 4/1979 | Walsh | 273/341.1 |
| 4,317,571 | A | * 3/1982 | Vrcic | 273/341.1 |
| 4,682,773 | A | 7/1987 | Pomilia | |
| 4,720,104 | A | * 1/1988 | DiSieno | 473/566 |
| 4,834,370 | A | * 5/1989 | Noble et al. | 473/566 |
| 5,312,308 | A | * 5/1994 | Hamilton et al. | 473/256 |
| 5,456,461 | A | 10/1995 | Sullivan | |
| 5,507,271 | A | * 4/1996 | Actor | 124/56 |
| 6,050,908 | A | * 4/2000 | Muhlhausen | 473/457 |
| 6,152,840 | A | * 11/2000 | Baum | 473/564 |
| 6,280,353 | B1 | * 8/2001 | Brundage | 473/457 |
| 6,682,447 | B1 | * 1/2004 | Black | 473/457 |
| 2001/0056001 | A1 | * 12/2001 | Gallagher | 473/564 |

FOREIGN PATENT DOCUMENTS

| | | | | |
|---|---|---|---|---|
| FR | 1287775 | A * | 2/1962 | 463/47.4 |

* cited by examiner

*Primary Examiner*—Mitra Aryanpour
(74) *Attorney, Agent, or Firm*—Frank L. Bernstein

(57) ABSTRACT

The present baseball training bat is comprised of a hollow tube with a handle portion and a hitting portion. The hitting portion is substantially smaller in diameter than that on a conventional baseball bat for improving swing accuracy. The distal end of the tube has an internal thread. Interchangeable threaded weight plugs of different lengths and weights are provided. The weight of any selected conventional bat can be closely simulated by installing in the distal end of the tube a suitable plug to produce substantially the same total weight. The plugs are also provided in materials of different densities. A plug in a denser material is shorter than another plug of the same mass but in a less dense material. The balance of the bat is thus changeable without changing the total weight by substituting plugs of the same mass but of different densities and lengths.

11 Claims, 2 Drawing Sheets

BASEBALL TRAINING BAT

BACKGROUND OF THE INVENTION

1. Field of the Invention

This invention relates generally to baseball bats, particularly to training bats with adjustable weight and balance for use in improving hitting accuracy, and for improving the transition from the aluminum bats used in collegiate games to wood bats used in professional games.

2. Prior Art

In the field of sport, it is generally agreed that hitting a thrown baseball is the single most difficult skill to master. Mastering this skill requires hundreds of hours of precise batting practice. Without practicing as perfectly and precisely as possible, the batter cannot acquire such hitting skill in the most efficient manner, if ever.

A conventional regulation baseball bat is comprised of a larger diameter hitting portion and a much smaller diameter handle portion. The hitting portion is larger for hitting the ball easier, and also heavier for positioning the center of gravity closer to the distal end of the bat for greater hitting power. Different models of bats handle differently because of variations in weight and balance. Such handling differences are particularly noticeable between solid wood bats and hollow aluminum bats since wood bats tend to be heavier at their distal ends. Aluminum bats are favored by amateurs because they are lighter and thus easier to swing against fast pitches, and they are much more durable. Wood bats are required by regulations for professional use.

After using a particular bat long enough, a player will become familiar with the feel of the bat and remember its handling qualities. Some highly experienced players can distinguish extremely small weight and balance differences. A player's performance will suffer if he switches from a familiar training bat to a different handling game bat for competition. Therefore, players prefer to practice with bats which are identical in handling to their game bats. Also, former amateur players who are used to aluminum bats generally have difficulty transitioning to wooden bats when they become professionals because of the vast handling differences.

Some prior art bats are provided with weight inserts for adjusting their weight. For example, a conventionally shaped bat disclosed in U.S. Pat. No. 1,499,128 to Shroyer, Jr. is provided with a weight insert which is threaded into its distal end. The weight insert may be cut to any length to adjust the total weight of the bat. Since the balance of the bat is affected by the size of the weight insert, the desired balance is unlikely to be achieved simultaneously with the desired weight. Although some adjustable bats include movable weights that can change the balance independently of the total weight, the movable weights might rattle or come loose during rigorous use. Therefore, most weighted bats are not suitable even for practice.

Another conventionally shaped bat disclosed in U.S. Pat. No. 2,379,006 to Johnson is provided with weights positioned in a hollow tube. The total weight of the bat is adjusted by changing the size or number of the weights. The balance of the bat can be adjusted by changing the position of the weight along the tube. The weight is fixed in a selected position by cork spacers at its opposite ends. Since the position of the weight is determined by the length of the spacers, the proper balance can only be achieved through a long trial-and-error process of trying different spacers and through extraordinary effort, so that the bat is not practical to use.

Most bats have a conventional shape in which the hitting portion is substantially larger in diameter than the handle portion. A training bat with a substantially smaller diameter hitting portion is disclosed in U.S. Pat. No. 4,682,773 to Pomilia. The smaller diameter hitting portion improves accuracy by requiring a more precise swing to hit a ball squarely. However, it is disclosed as much heavier than a conventional bat, and has a weight-to-length ratio which is constant along the bat rather than being greater near the end of the bat. Since its weight and balance are not adjustable and significantly different from those of a conventional bat, it is not desirable as a practice bat.

OBJECTIVES OF THE INVENTION

Accordingly, the objectives of the present baseball training bat are:

- to have a smaller diameter hitting portion for improving swing accuracy;
- to be adjustable in weight to closely simulate the feel of a conventional aluminum or wood bat;
- to be adjustable in balance to closely simulate the feel of a conventional aluminum or wood bat;
- to help an aluminum bat user/to adjust to wood bats;
- to be adjustable in balance without changing the total weight;
- to be very easily adjustable; and
- to be very durable.

Further objectives of the present invention will become apparent from a consideration of the drawings and ensuing description.

BRIEF SUMMARY OF THE INVENTION

The present baseball training bat is comprised of a hollow tube with a handle portion and a hitting portion. The hitting portion is substantially smaller in diameter than that of a conventional baseball bat for improving swing accuracy. The distal end of the tube has an internal thread. Interchangeable threaded weight plugs of different lengths and weights are provided. The weight of any selected conventional bat can be closely simulated by installing in the distal end of the tube a suitable plug to produce substantially the same total weight. The plugs are also provided in materials of different densities. A plug in a denser material is shorter than another plug of the same mass but in a less dense material. The balance of the bat is thus changeable without changing the total weight by substituting plugs of the same mass but of different densities and lengths.

DRAWING REFERENCE NUMERALS

10. Tube
11. Handle Portion
12. Hitting Portion
13. Grip
14. Knob
15. Proximal End

16. Sleeve
17. Label
18. Distal End
19. Internal Thread
20. Weight Plug
21. External Thread
22. Flange
23. Internal Portion
24. External Portion
25. Weight Plug
26. Internal Portion
27. Weight Plug
28. Internal Portion
29. External Portion
30. External Portion
31. Weight Plug
32. Weight Plug

DETAILED DESCRIPTION OF THE INVENTION

Figure 1:
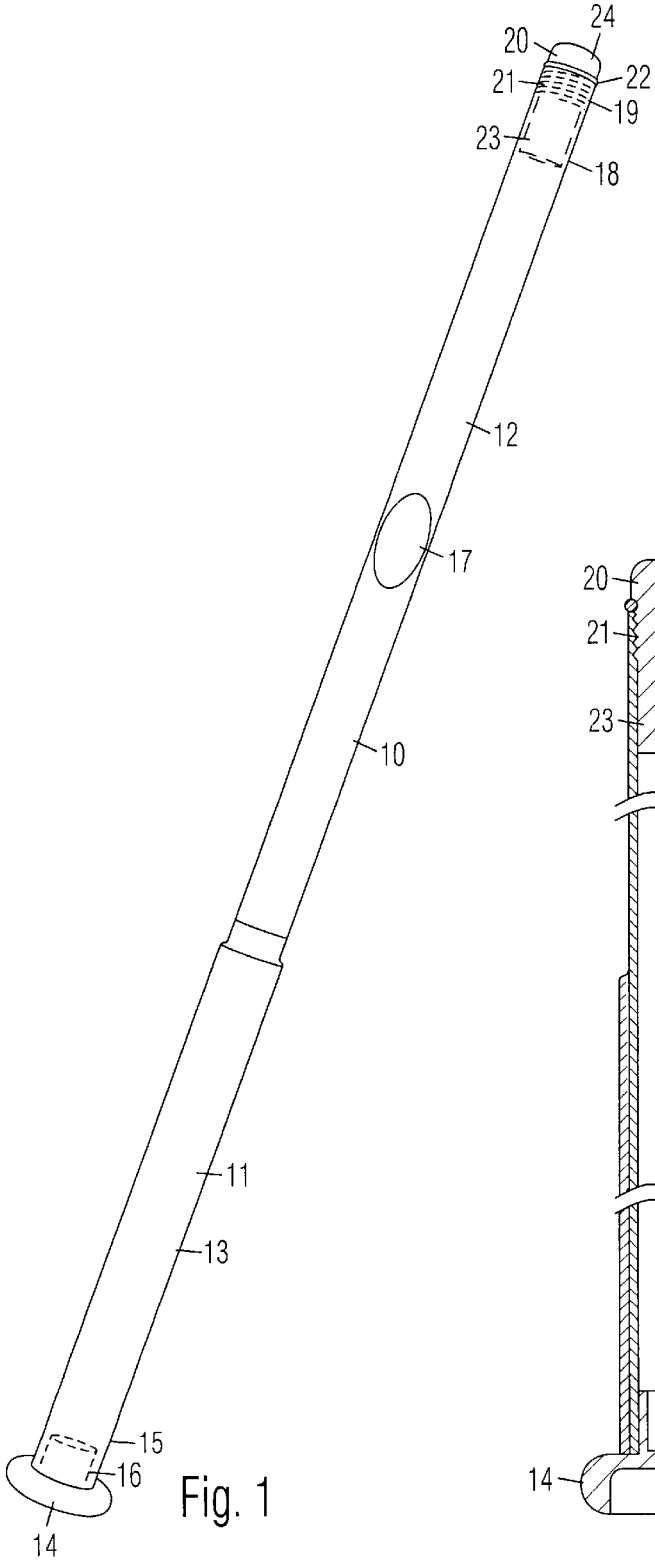
FIG. 1 is a side view of the present baseball training bat.
Figure 2:
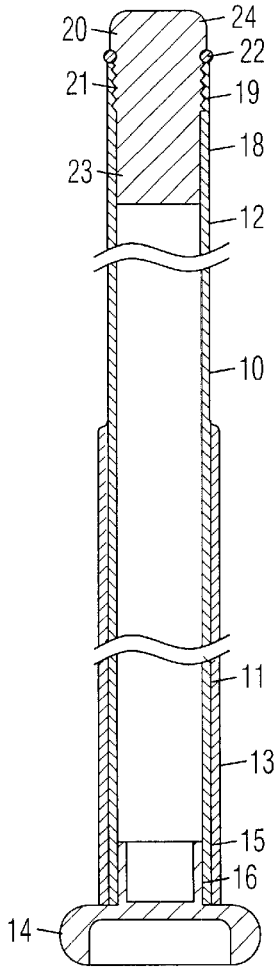
FIG. 2 is a side sectional view of the training bat.

FIGS. 1–2:

A preferred embodiment of the present baseball training bat is shown in a side view in FIG. 1 and a side sectional view in FIG. 2. It is comprised of a hollow tube 10 with a handle portion 11 and a hitting portion 12 which is substantially smaller in diameter than the hitting portion of a conventional baseball bat. Since a much more accurate swing is required to hit a ball squarely with such a thin hitting portion, a player's skill is improved by practicing with the present training bat. Practice can be made more or less challenging by using balls which are respectively smaller or larger than a conventional baseball. Practice can be done indoors by using practice balls which are made of a relatively soft and light weight material, such as foam, hollow plastic, or hollow rubber.

Handle portion 11 and hitting portion 12 are preferably made of a single metal tube of uniform diameter throughout for simplicity. The preferable diameter is about 0.87 to 1.00 inch. Handle portion 11 is wrapped with a padded grip 13 for comfort and to avoid slipping. A knob 14 is attached to a proximal end 15 of tube 10, wherein a sleeve 16 extending from knob 14 is securely fixed inside tube 10. A label 17 is attached to hitting portion 12, preferably at about 60% of the bat length from the proximal end, for displaying information such as a trademark, manufacturer information, etc. A distal end 18 of tube 10 has an internal thread 19.

An interchangeable weight plug 20 with an external thread 21 is screwed into distal end 18 of tube 10. Weight plug 20 may be secured with an adhesive to prevent loosening during use. A seal or flange 22 is provided around weight plug 20 forward of external thread 21 to limit the insertion depth. Flange 22 is preferably a resilient O-ring. The diameter of an internal portion 23 of weight plug 20 is slightly smaller than the internal diameter of tube 10. An external portion 24 of weight plug 20 forward of flange 22 is of a predetermined, fixed length. Except flange 22, the entire weight plug is preferably a single integral part, that is, a continuous piece of metal along its length, so that there are no parts that can break away during use. Alternatively, flange 22 may also be an integral metal part of weight plug 20. The weight and density of plug 20 are selected so that the total weight and balance of the training bat closely simulates the weight and balance of the player's conventional game bat.

Figure 3:
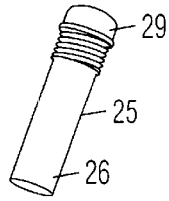
FIG. 3 is a side view of an interchangeable weight plug.
Figure 4:
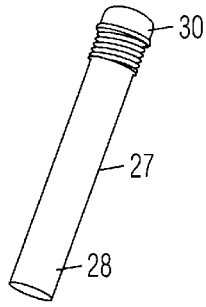
FIG. 4 is a side view of another weight plug.

FIGS. 3–4:

The bat is provided with a plurality of interchangeable weight plugs with internal portions of different lengths. The plugs may be provided for installation by a user, or they may be provided only for installation by a manufacturer. A weight plug 25 shown in FIG. 3 has a shorter internal portion 26 and is thus lighter than a weight plug 27 shown in FIG. 4 of the same material but with a longer internal portion 28. The respective external portions 29 and 30 of plugs 25 and 27 are preferably of the same length. When the weight plugs are provided in enough weight increments, the weight of any conventional game bat can be closely simulated by installing the appropriate weight plug.

Figure 5:
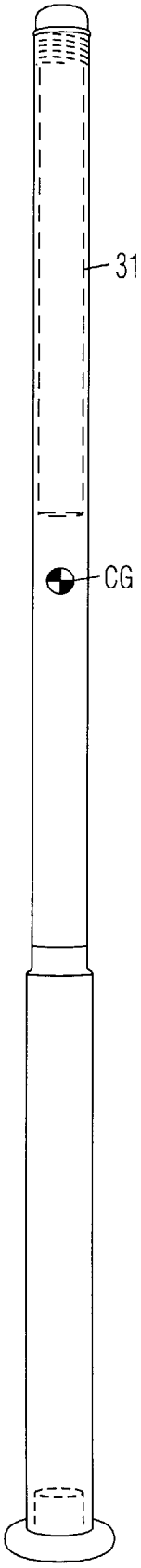
FIG. 5 is a side view of the bat with a less dense weight plug.
Figure 6:
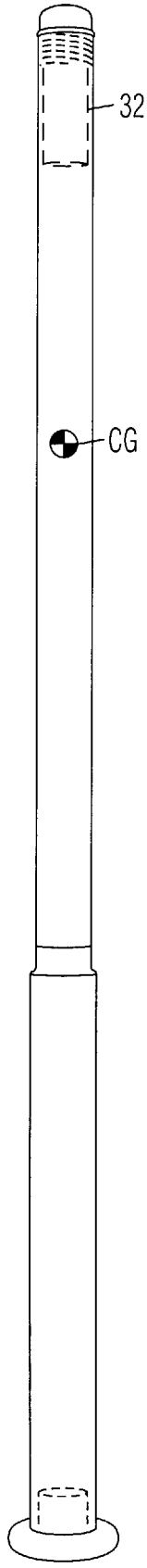
FIG. 6 is a side view of the bat with a denser weight plug.

FIGS. 5–6:

The training bat's weight is dependent on the length of the weight plug, and the bat's center of gravity or balance is also dependent on the length of the weight plug. The closer the plug extends toward the middle of the bat, the heavier the bat is, and the closer to the middle the center of gravity is. If a selected weight plug 31 has the correct mass for providing the desired total weight in the training bat, but is so long that the center of gravity CG is too far back, such as in FIG. 5, a shorter weight plug 32 of the same mass but a denser material may be substituted to shift the center of gravity CG forward, such as in FIG. 6, to more closely simulate the balance of a player's conventional game bat. A plug in a denser material, such as stainless steel, is inherently shorter than a plug of the same mass and diameter but a less dense material, such as aluminum.

A selection of interchangeable plugs of generally equivalent mass may be provided in materials of different densities for adjusting the bat's balance while keeping the total weight constant. The weight and balance may be adjusted to closely simulate any conventional bat by selecting the weight plug with a suitable combination of mass and density/length. The swing feel of the training bat may thus be adjusted to closely simulate the player's conventional game bat. Therefore, the player's performance is maintained when switching from the training bat to the game bat.

A major advantage of the training bat is that it can be used to help a player who is accustomed to an aluminum bat to adjust to a wood bat, for example, as the player becomes a professional. The method is comprised of using a suitable weight plug to provide a total weight and center of gravity which are between the player's personal aluminum bat and the desired wood bat. The training bat is used for a period of time until the player becomes accustomed to the new swing feel. Additional weight plugs may be substituted to provide additional intermediate levels of swing feel to gradually accustom the player to the swing feel of the wood bat.

SUMMARY AND SCOPE

Accordingly, the small diameter hitting portion of the present baseball training bat improves swing accuracy. It is adjustable in weight and balance to closely simulate the handling feel of the player's conventional game bat. It can be used to improve the transition from aluminum to wood bats. It is easily adjusted by changing the weight plug. It is also very durable and reliable because it has no moving or easily breakable parts.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A baseball training bat, comprising:

a hollow tube with a handle portion toward a proximal end and a hitting portion toward a distal end;

wherein said hitting portion and said handle portion are generally identical in diameter, and said hitting portion is substantially smaller in diameter than a hitting portion of a conventional baseball bat for helping improve hitting accuracy; and an elongated weight plug with an outer end fixedly positioned in said distal end of said tube, and an inner end extending partially into said tube; wherein said weight plug is comprised of a continuous piece of metal between said outer end and said inner end for simplicity and reliability; and said weight plug has a predetermined weight and a predetermined length that when combined with said tube, said training bat is adapted to closely approximate said conventional baseball bat in total weight and balance for closely simulating said conventional baseball bat in swing feel.

2. The baseball training bat of claim 1, wherein said diameter of said tube is about 0.87 inch to about 1.00 inch.

3. The baseball training bat of claim 1, further including an internal thread at said distal end of said tube mated with an external thread adjacent said outer end of said weight plug for security.

4. The baseball training bat of claim 1, further including additional weight plugs of different lengths and correspondingly different weights interchangeably positioned in said distal end of said tube for closely simulating the total weight and the balance of additional conventional baseball bats.

5. The baseball training bat of claim 1 further including a flange around said weight plug adjacent said outer end to limit an insertion depth of said weight plug into said tube.

6. The baseball training bat of claim 1, further including a padded grip wrapped around said handle portion for comfort and to avoid slipping.

7. The baseball training bat of claim 1, further including a knob attached to said proximal end of said tube to help prevent said training bat from slipping off a player's hands.

8. A method for providing a training baseball bat which closely approximates a conventional baseball bat in swing feel, comprising the steps of:

providing a hollow tube with a handle portion and a hitting portion which are generally identical in diameter, wherein said hitting portion is substantially smaller in diameter than a hitting portion of said conventional baseball bat for improving hitting accuracy;

providing a plurality of weight plugs of different weights and correspondingly different lengths, wherein each of said weight plugs is comprised of a continuous piece of metal between an outer end and an inner end thereof for reliability;

fixedly securing a selected one of said weight plugs within a distal end of said tube, wherein said selected one of said weight plugs has a predetermined weight and a predetermined length that when combined with said tube, said training bat is adapted to closely simulate said conventional baseball bat in total weight and balance, and thus closely simulate said conventional baseball bat in said swing feel.

9. The method of claim 8, wherein some of said weight plugs are of different densities for providing additional flexibility in adjusting the balance of said training bat, since different weight plugs of similar weight but different densities are of substantially different lengths which are suitable for adjusting the balance while keeping said total weight constant.

10. A method for helping a baseball player who is accustomed to an aluminum bat to adapt to a wood bat, comprising:

providing a training bat comprising a hollow tube with a handle portion and a hitting portion which are generally identical in diameter, wherein said hitting portion is substantially smaller in diameter than a hitting portion of a conventional baseball bat for improving hitting accuracy;

fixing a weight plug within a distal end of said tube, wherein said weight plug has a predetermined weight and a predetermined length that, when combined with said tube, provide an intermediate total weight and an intermediate balance in said training bat which are between said aluminum bat and said wood bat; and using said training bat for a period of time until the player becomes accustomed to the intermediate weight and the intermediate balance.

11. The method of claim 10, further including substituting additional weight plugs of increasing weight to provide a gradually increasing total weight and a gradually increasing balance to gradually accustom the player to said wood bat.

* * * * *